United States Patent [19]

Levin

[11] 4,098,562

[45] Jul. 4, 1978

[54] REINFORCED CONCRETE BLOCK MAKING MACHINE

[75] Inventor: Albert R. Levin, Wilton, Conn.

[73] Assignee: Energy Conservation Techniques Inc., Wilton, Conn.

[21] Appl. No.: 750,432

[22] Filed: Dec. 14, 1976

[51] Int. Cl.[2] ..... B28B 1/24

[52] U.S. Cl. ..... 425/121; 425/123; 425/125; 425/126 R; 425/129 R; 425/298; 425/595

[58] Field of Search ..... 425/404; 425/88, 123, 425/125, 126, 129, 242, 298, 392, 404, 446, 121, 595

[56] References Cited

U.S. PATENT DOCUMENTS

| | | | |
|---|---|---|---|
| 2,469,599 | 5/1949 | Hawes | 425/123 |
| 2,614,308 | 10/1952 | Burkard et al. | 425/123 |
| 3,050,808 | 8/1962 | Clanton et al. | 425/123 |
| 3,522,336 | 7/1970 | Piper et al. | 425/404 |
| 3,825,394 | 7/1974 | Pietrowiak | 425/88 |
| 3,966,375 | 6/1976 | Fukushima et al. | 425/88 |

*Primary Examiner*—Francis S. Husak
*Assistant Examiner*—John McQuade
*Attorney, Agent, or Firm*—Jacobs & Jacobs

[57] ABSTRACT

A process and machine are described for the continuous production of reinforced concrete blocks in which a reinforcement member is cut and formed, positioned in an area of a molding station, a divided mold cavity is then defined about the reinforcement member and a paired block formed about the reinforcement member by introduction into the molding cavity of a hot slurry of cement fluid. The paired block thus formed is advanced on a pallet about circular conveyor means, passing through a curing area and ejection station where the cured block is removed from the pallet and the pallet returned to the molding station.

8 Claims, 10 Drawing Figures

DRY STORAGE
HEAT
MIX
STEAM (WATER)
P
MANIFOLD
V REL
CURE

REINFORCED CONCRETE BLOCK MAKING MACHINE

DETAILED DESCRIPTION

The present invention pertains to a machine for the continuous preparation of a paired reinforced concrete block. Traditionally, concrete block has been produced by introducing into a mold box the dry ingredients, primarily cement and inert filler, containing about 10% of the moisture required for hydration. The mold box is then vibrated to shake down the material and to produce a sufficient density to permit the material to maintain the shape of the mold box. The stable block is then further humidified, either by a yard cure over a period of as much as 28 days or alternatively in a kiln having a steam atmosphere, in which case sufficient hydration occurs in 10 to 12 hours to harden the block. More recently, autoclave methods have been employed to accelerate the penetration of moisture.

Recently, concrete blocks have been produced in more intricate designs and configurations. These include pair blocks which have improved thermal and insulating properties. For example, concrete blocks have been produced having a pair of walls with one or more internal air cavities joined by a metal reinforcement member. Apart from the difficulty in positioning and aligning the reinforcement member during manufacture, the interlocking nature of such blocks creates an increased need for precision and reproducibility in their production.

The present machine and process are primarily directed at the preparation of such paired reinforced blocks, although it will be clear that the machine can easily accommodate the preparation of traditional concrete blocks. In particular, the present machine permits the rapid production of concrete blocks of a higher density and intricate configuration with absolute control over dimension variation. The machine and process also permits the precise placement of reinforcing members within the block, thereby maximizing the strength of the block and again leading to greater reproducibility. The machine and process operate in a minimum area and eliminate the usual curing requirements and storage areas.

These and other objects of the invention will be apparent from the following disclosure and from the figures, in which.

Figure 3A:
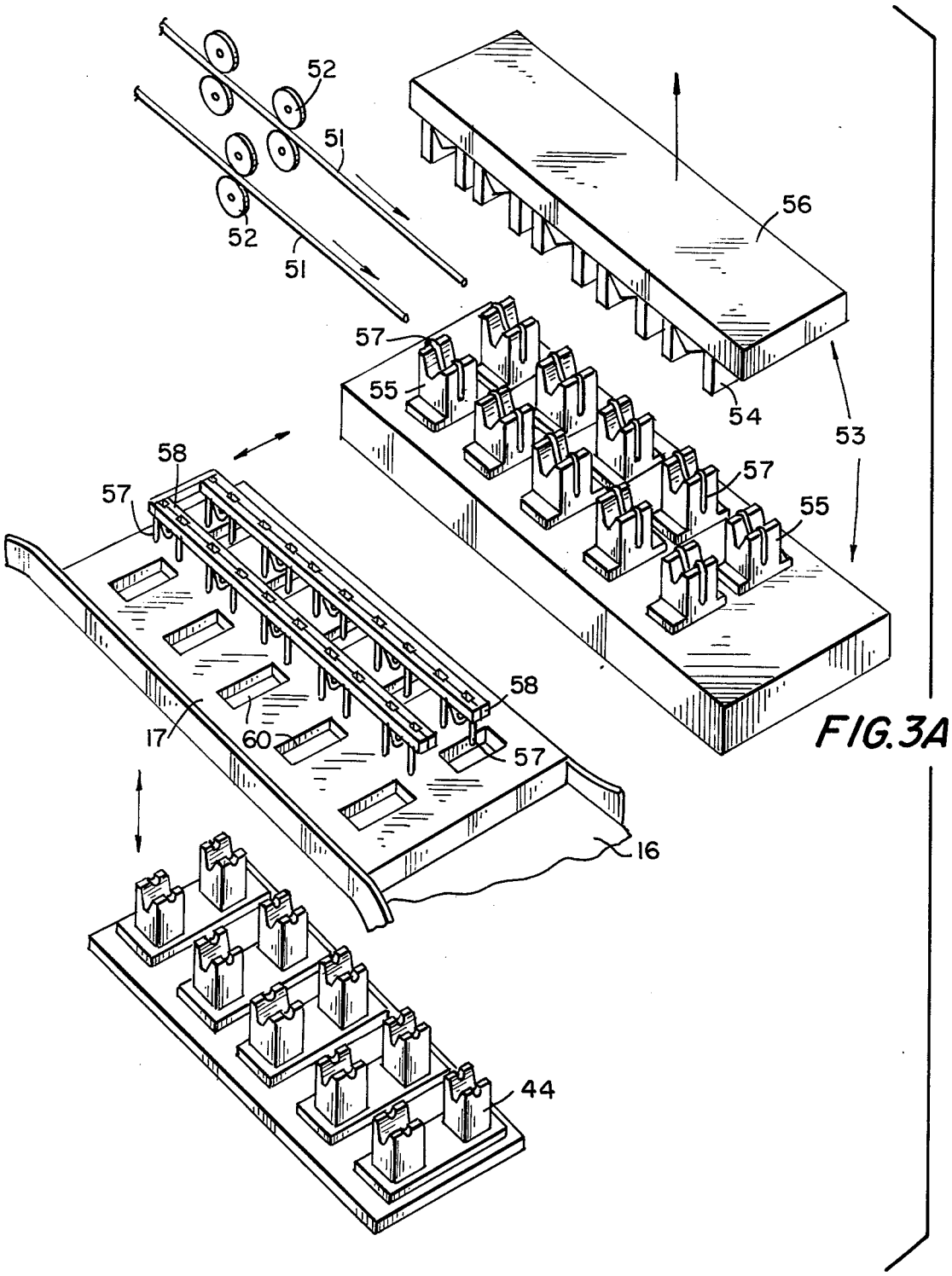
Figure 3B:
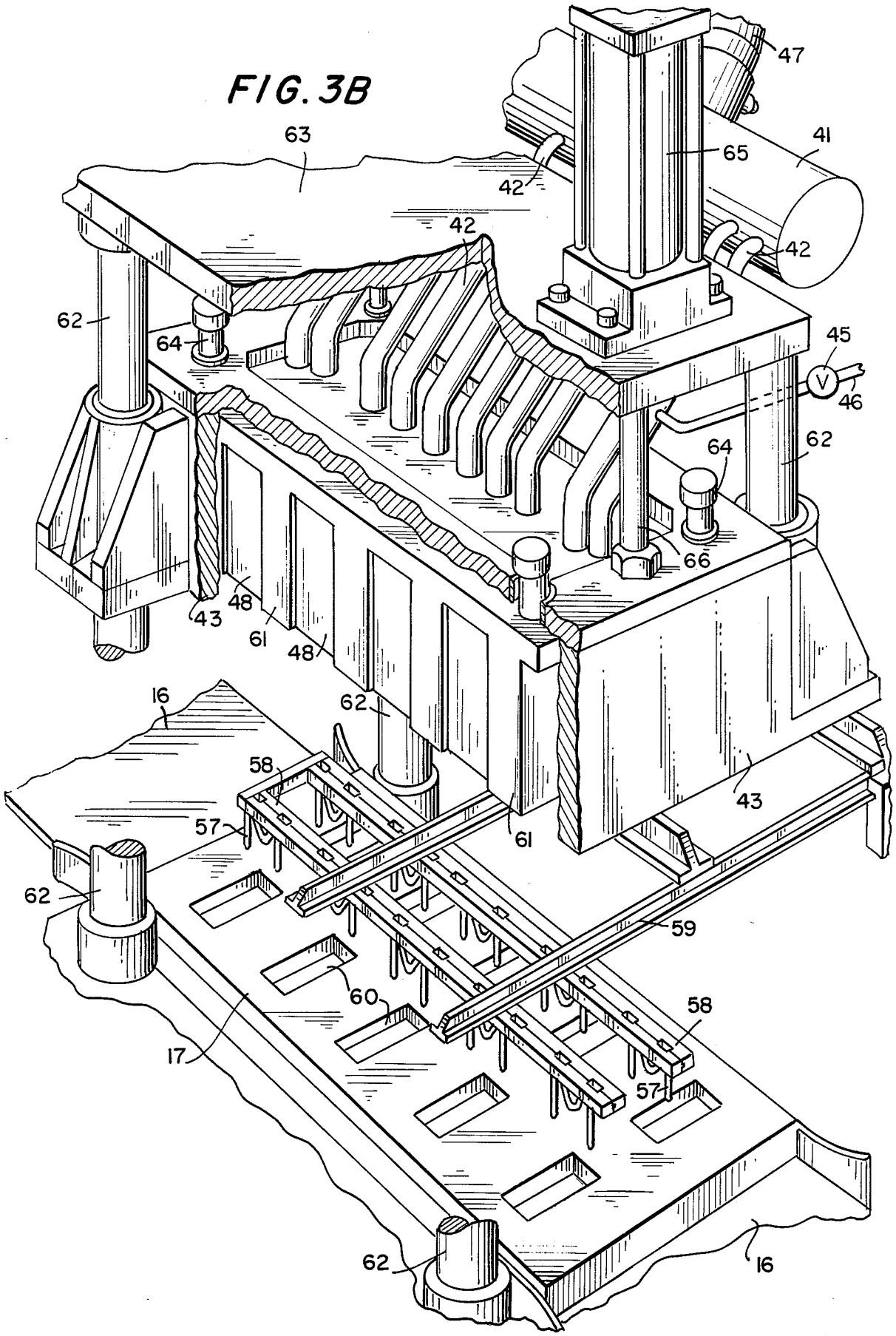

FIGS. 3A and 3B are exploded perspective views of the components involved in the cutting and forming of the reinforcement members, their insertion in the molding cavity area and the block molding station; and FIGS. 4A–4D are schematic presentations of the individual phases in one cycle of the cutting and forming of the reinforcement members, their insertion in the molding cavity, and the molding of a paired reinforced block.

Figure 1:
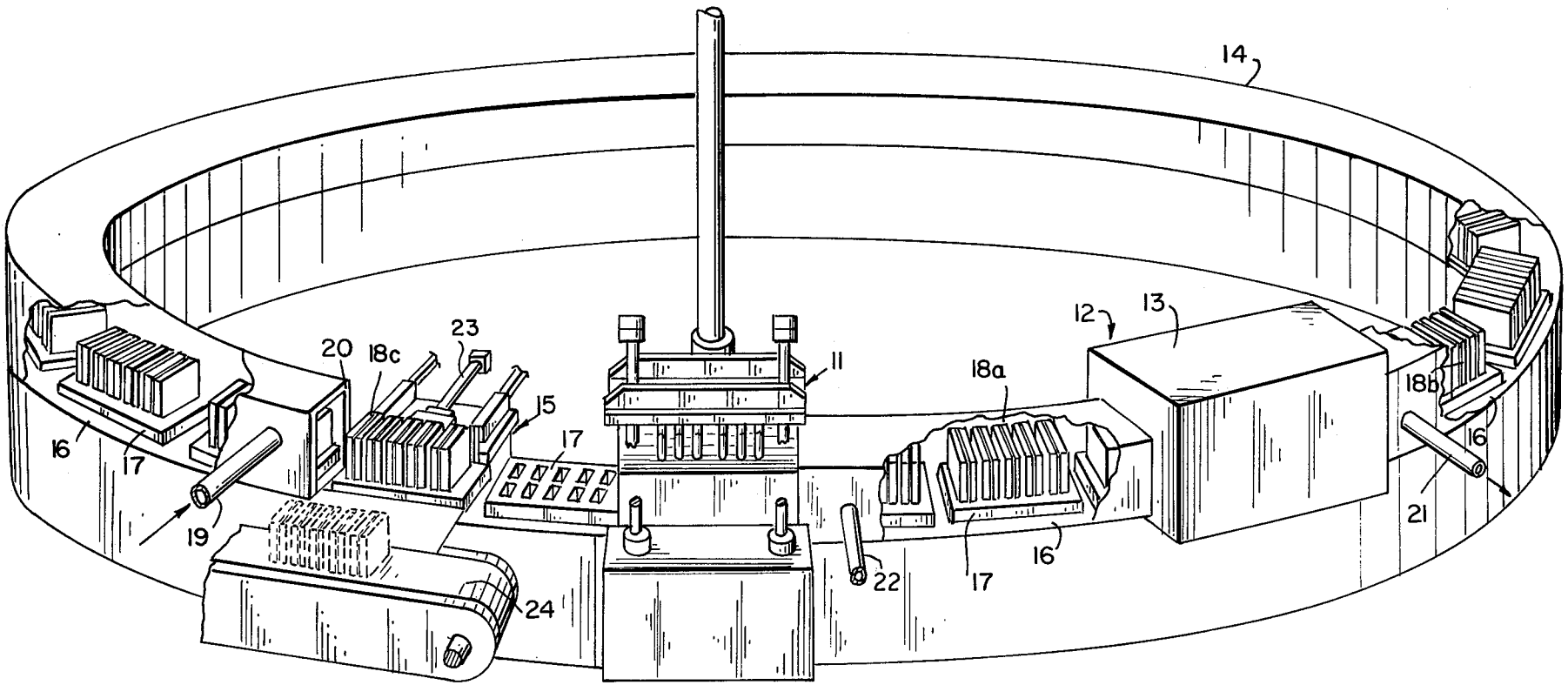
FIG. 1 is a perspective view of the circular production components including molding station, curing area and ejector station.

Referring now in greater detail to the drawings, there is shown in FIG. 1 the components of the present invention arranged in a circular configuration (it being apparent that other configurations such as an oval which permits continuous return can of course be used). These components include molding station shown generally at 11, a curing area shown generally at 12 including heater 13 and cooling area 14, and ejector station 15.

Reinforced concrete blocks 18*a*, produced at molding station 11, are conveyed to heater 13 by circular conveyor 16 which travels about the entire turntable apparatus. The blocks conveyed about conveyor 16 on pallets 17 which are of a special configuration, discussed below.

As is also discussed below, reinforced concrete blocks 18*a* emerging from molding station 11 contain excess moisture and this is removed in heater 13 of curing area 12. Any conventional heating means can be employed for this purpose. A particularly advantageous method utilizes a high frequency induction heater so that as blocks 18*a* are moved through two optionally disposed plates (not shown), the block acts as a dielectric and becomes rapidly heated. As a result, the moisture is eliminated through uniform heating in a matter of from 2 to 6 minutes. Upon the elimination of the moisture, the absorption of energy substantially ceases and the dry block 18*b* is advanced to cooling area 14 of curing area 12.

The dried block 18*b* is then transported by circular conveyor 16 through cooling area 14. The blocks can there be subjected to further cooling and drying by the passage of air introduced at inlet pipe 19, where it meets the coolest block first, and then circulated clockwise through tunnel 20 where it gradually increases in temperature and humidity, emerging at outlet pipes 21 and 22. Inlet pipe 19 and outlet pipes 21 and 22 can be suitably valved (not shown) to control the amount of air being introduced and both the amount and position of the air being removed after the cooling cycle. The heated and humid air emerging from outlet pipes 21 and/or 22 can be conduited to a heat exchanger (not shown) with the heat thus collected being utilized in other heating operations, discussed below. Tunnel 20 can be provided with curtains (not shown) to minimize the loss of air utilized in the cooling and the air can of course be either introduced under pressure or removed under reduced pressure.

Fully cured block 18*c* is further transported by a pallet 17 to ejection station 15 where ejection means remove the block from pallet 17. The ejection means can include a ram 23 or any equivalent removal device. Cured block 18*c* is then removed from the production area as for example by secondary conveyor 24.

Pallet 17, with the cured block 18*c* removed, is then advanced to the molding station 11 for a repeat of the above described cycle.

Figures 2A, 2B, 2C:
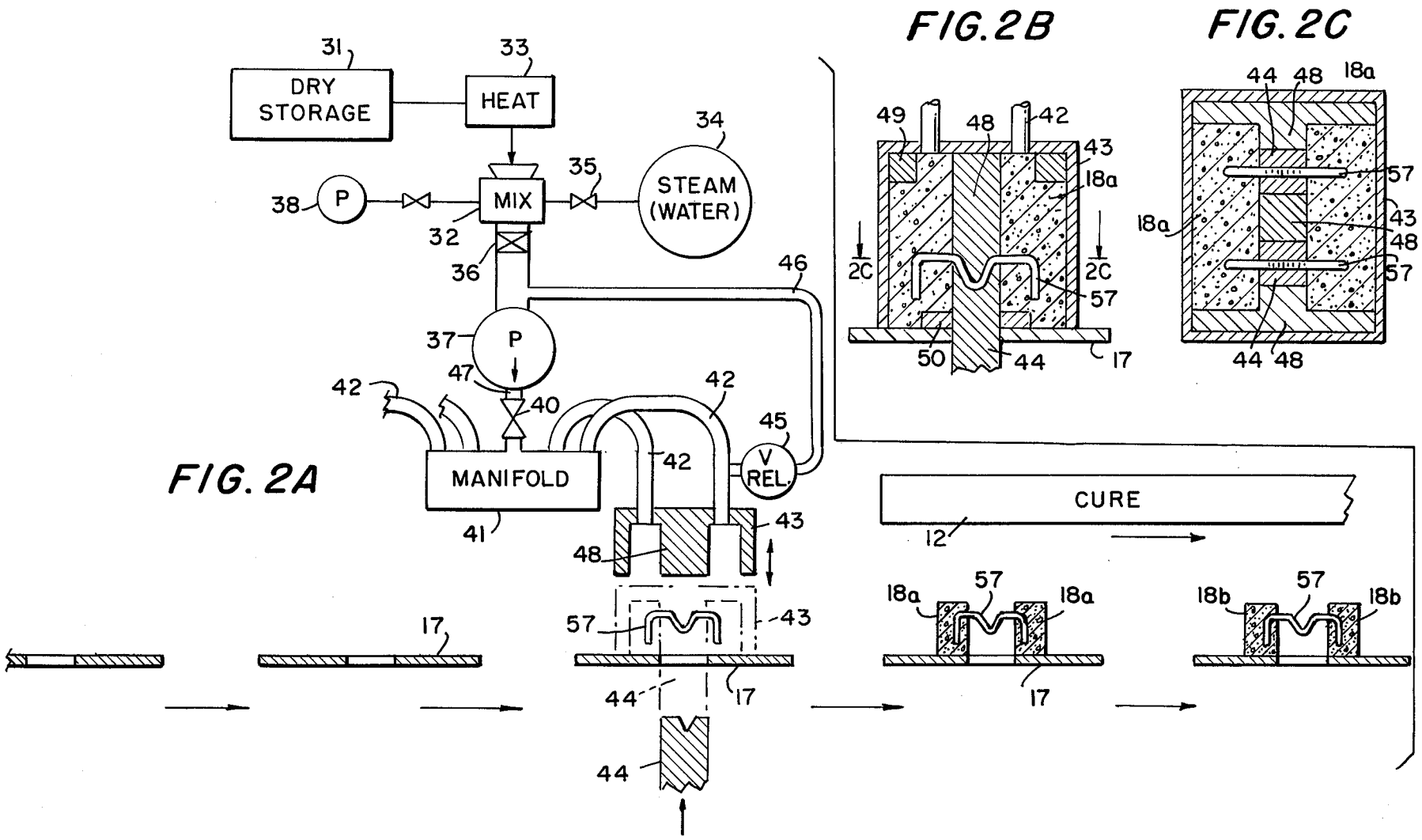
FIG. 2A is a schematic drawing of the mixing, molding, curing and ejection operation.
FIG. 2B is a verticle cross-section of the components of the mold form during the molding operation for a paired reinforced block.
FIG. 2C is a horizontal cross-section of the components of the molding form during the molding operation taken along lines 2C—2C of FIG. 2B.

With greater particularity to the molding operation, and with additional reference to FIG. 2A, the dry components from which the block will be formed, the ingredients and consistency of which will depend upon the ultimate use but can include such materials as cement, sand, cinder, pumice, gravel, aggregate, pigment and the like, are maintained in dry storage area 31 and conveyed to mixer 32 by conventional means. It is particularly advantageous to heat the dry mixture, as by passing it through heater 33, for which purpose some or all of the heat recaptured from the air emerging from outlet ports 21 and 22 (shown on FIG. 1 but not FIG. 2)

can be utilized.

In mixer 32, the dry ingredients are combined with water, either in the form of extremely hot water or even steam supplied by water heater 34, the amount being controlled by valve 35. Mixer 32 can be compartmentalized into several different chambers, including a preliminary mixing, intermediate mixing and final mixing areas (not shown) with appropriate mixing blades (not shown). The supply of dry mix from dry storage area 31 and hot water or steam from water heater 34 can be controlled so as to provide a continuous supply of a heated slurry of concrete fluid, prepared in mixer 32, sufficient to meet the demands of the entire system; e.g. at a rate for example of about 60 tons per hour. The use of heated dry mix and more particularly hot water or steam results in the almost immediate initiation of hydration of the cement.

Upon demand, valve 36 is opened and the heated slurry of concrete fluid is expelled from mixer 32 to pump 37. This can be facilitated by use of compressor 38 which when valve 39 is opened, forces air into mixer 32.

Upon activation of pump 37 and the opening of valve 40, the heated slurry of concrete fluid is pumped into manifold 41 for distribution through high pressure hoses 42 into the molding cavity. As shown in FIGS. 2B and 2C, the molding cavity is defined by upper molding form 43, pallet 17 and lower molding form 44. Within upper molding form 43 is disposed an inner mold divider 48 which results in the formation of a paired block, each half of which is joined by reinforcement member 57. Additional molding components 49 and 50 can be disposed either on the interchangeable inner mold divider 48 (as in the case of 49) or removably fixed to pallet 17 (as in the case of 50).

The heated slurry of concrete fluid is pumped into this cavity at a pressure of approximately 125 lbs. per square inch, thereby filling the cavity with the fluid. Any excess fluid which is pumped into the cavity after it is filled is diverted by activation of relief valve 45 and the diversion of excess fluid through conduit 46 for recycling.

As will be discussed below, the heated slurry of concrete fluid rapidly hydrates in the mold cavity within a matter of seconds to the point where the block has sufficient rigidity to be removed from the mold. It is then advanced on pallet 17 moving on circular conveyor 16 (not shown in FIG. 2A but shown in FIG. 1) to the curing area 12, as already discussed in connection with FIG. 1.

The operation of the molding station and its cooperation with the means for cutting and forming the reinforcement members can be seen from FIGS. 3A, 3B and 4A–4D. Wire 51 is fed through wire straighteners 52 into gap press 53 having upper dies 54 and lower dies 55. Dies 54 and 55 are single operation dies of a configuration which can be varied depending upon the design features and reinforcement needs of the blocks being prepared. Upper dies 54 are secured to the lower surface of bolster 56 of gap press 53. Upon vertical reciprocal motion of bolster 56, a plurality of reinforcement members are cut from the stock wire 51 and formed between upper die 54 and lower die 55 (see FIG. 4A). Upon reciprocation of bolster 56, the reinforcement members are left resting on lower die 55 (see FIG. 4B).

It is generally economical to produce several paired blocks in each molding operation, as for example four or five paired blocks. Each paired block in turn can contain more than one reinforcement member so that for the molding of a plurality of blocks in a single operation, the reinforcement members are cut and formed in a whole number multiple of that plurality with the quantity of the reinforcement members in each paired block corresponding to that whole number. In such an operation, several cutting and forming operations can advantageously be performed simultaneously with a series of lower dies 55 being arranged in several parallel lines with a corresponding number of stock feeding mechanisms.

The cutting and forming of the reinforcement members, although not shown in FIG. 1, is preferably performed from continuous stock advancing along a line parallel to a tangent to circular conveyor means 16, the tangent being at molding station 11. In this way, the reinforcement members 57 are transferred in a manner now to be described from the cutting and forming station to molding station 11 along a line which is at right angles to the axis along which both upper molding form 43 and lower molding form 44 moves and to the tangent to the circular conveyor means at molding station 11; i.e. the tangential direction which the blocks proceed from the molding station.

Figure 4A:
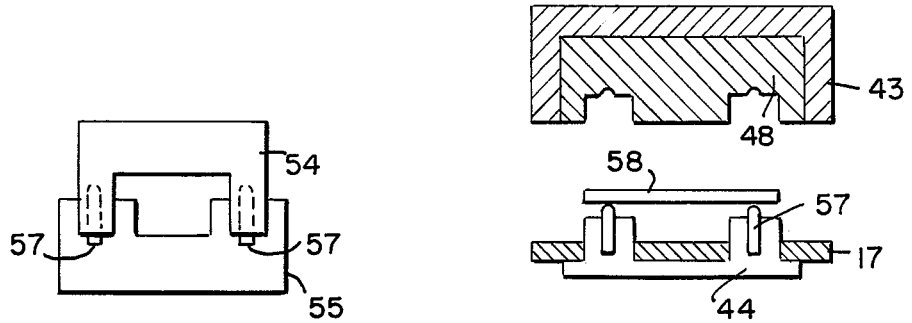
Figure 4B:
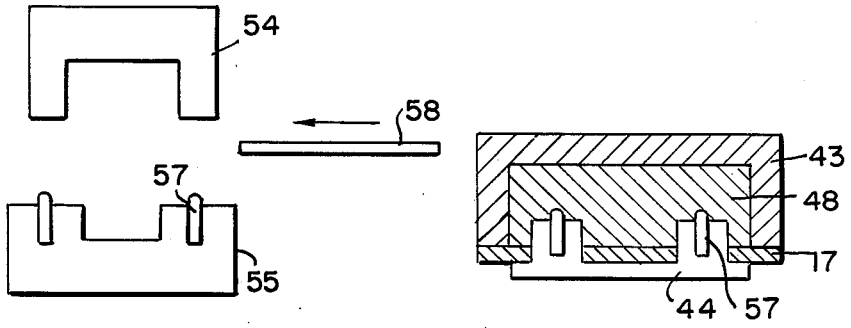
Figure 4C:
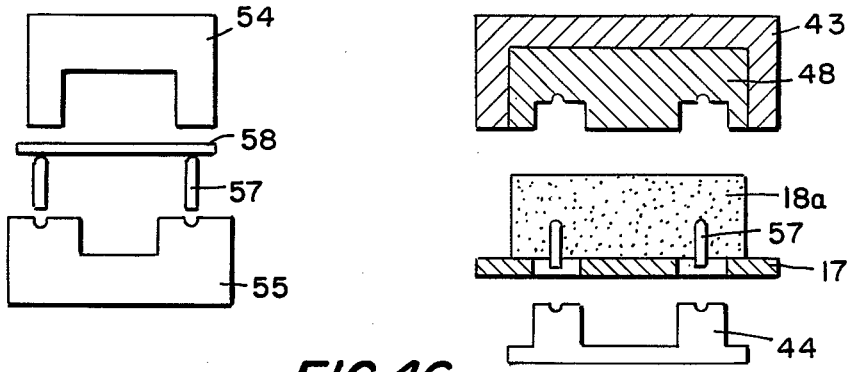
Figure 4D:
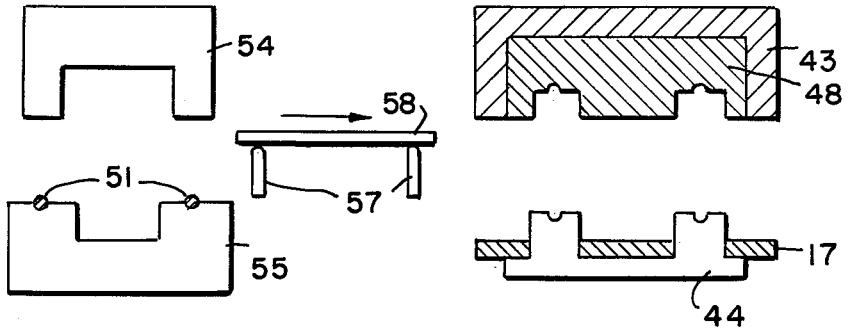

The means for transferring reinforcement members 57 includes pickup member 58 which is mounted on supports 59 for reciprocal motion from a position over cut and formed reinforcement members 57 resting on lower dies 55 (see FIG. 4C) to a position over lower molding form 44 in the area in which the molding cavity will subsequently be defined (see FIG. 4A). Pickup member 58 can effect the pickup through magnetic means or through appropriate pincing action in a manner well known to the art in order to convey the reinforcement members from lower die 55 to the molding cavity area and move by conventional means such as a hydraulic cylinder, not shown. Lower molding form 44 simultaneously or previously has been raised from a lower retracted position to an elevated position in which it is indexed through openings 60 in pallet 17. Reinforcement members 57 are then released from pickup member 58 and dropped onto lower mold form 44 which can be of an appropriate configuration to receive the reinforcement members (see FIG. 4A). Pickup members 58 and their supports are then reciprocated out of the area corresponding to the molding cavity (see FIG. 4B) and returned to gap press 53 in order to effect the transfer of additional reinforcement members which have been cut and formed during this transfer operation (see FIG. 4C). When the pickup member 58 and its supports 59 have cleared the area corresponding to the molding cavity, upper molding form 43 carrying inner mold divider 48 drops until these rest upon pallet 17. Upper molding form 43, those portions of lower molding form 44 extending through pallet 17, and inner mold divider 48 thus define the molding cavity (see FIG. 4B).

As has already been noted, it is generally economically desirable for the upper and lower molding forms to define a plurality of paired block forming cavities. This can be readily accomplished as shown in FIG. 3B by providing the upper molding form 43 with a plurality of suitable partitions 61. Disposed within each pair of partitions 61 and forming part of upper molding form 43 is inner mold divider 48 which is designed to be interchangeable to accommodate different block configurations. This is designed to mesh with lower molding form 44 to bifurcate the molding cavity and produce a paired concrete block joined through reinforcement member 57.

Upper molding form 43 is supported for movement from a molding position to a retracted position by a series of posts 62 which are positioned in such a fashion as to permit pickup member 58 to move freely in and out of the area defining the molding cavity. Also carried on post 62 is an upper support plate 63 upon which are optionally disposed manifold 41 and manifold pipes 42. When manifold 41 is fixed to upper support plate 63, conduit 47 leading to valve 40 (see FIG. 2A) must be flexible in order to accommodate the reciprocating motion of upper molding form 43 during the molding operations. On the other hand, if manifold 41 is fixed then pipes 42 should be flexible in order to accommodate the same motion.

There can also be disposed on the upper molding form a series of adjustment screws 64 which permit both the exchange of partition 61 and inner molding divider 48 and the fine adjustment of these components.

Fixed to the top of upper support plate 63 is a hydraulic cylinder 65, of which only one is shown in FIG. 3A but of which there are generally at least two, disposed on either side of support plate 63. Piston rod 66 extends through upper support plate 63 and acts upon upper mold form 43 when upper mold form 43 has been dropped so as to rest upon pallet 17 and the heated slurry of concrete fluid has been injected into the molding cavity.

The movement of upper molding form 43 and lower molding form 44 from their first molding position to their second retracted positions can be effected through any conventional means such as the hydraulic means indicated, appropriate cams, or any other mechanism which will permit the time sequence described for the molding operation. It is also apparent that conveyor means 16 may be a solid conveyor belt which is diverted at the molding station in order to accommodate the mechanism beneath the pallet involving the lower molding form, or alternatively can be a segmented drive which does not interfere with the positioning of pallet 17 in the molding station and the movement of the lower molding form 44.

The operation cycle can be described as follows. Wire 51 is fed into gap press 53 between upper die 54 and lower die 55, there being sufficient stock to provide the requisite number of reinforcement members. The downstroke of press bolster 56 cuts and forms the reinforcement members 57 from wire stock 51. Upon upstroke of bolster 56, pickup member 58 moves over lower dies 55 and lifts the reinforcement members 57 resting thereon. Pickup member 58 carries the reinforcement members from the cutting and forming area to the area corresponding to the mold cavity. An empty pallet 17 advanced by conveyor means 16 moves into position between upper molding form 43 and lower molding form 44. When pallet 17 is in position, lower molding form 44 is raised from its retracted position into a position in which it indexes through the openings 60 of pallet 17, arriving in position at least by the time pickup member 58 transports reinforcement members 57 to the molding cavity area. Pickup member 58 then deposits the reinforcement members 57 on lower molding form 44 and then returns to the cutting and forming area where a new set of reinforcement members have been or are being prepared. Upon withdrawal of pickup member 58, upper mold form 43 and its upper support plate 63 descend until upper molding form 43 and its inner mold divider 48 rest upon pallet 17. The upper molding form 43, its divider 48, pallet 17 and those exposed portions of lower molding form 44 extending through opening 60 of pallet 17 thus define the molding cavity with reinforcement members 57 positioned therein. Pump 37 is then activated, valve 40 is in an open position and the heated slurry of concrete fluid is pumped into manifold 41, through pipes 42 and into the molding cavity just described. The molding cavity is completely filled and any excess concrete slurry is returned through relief valve 45 for recycling.

When the mold cavity is filled to its measured capacity, hydraulic cylinder 65 exerts pressure against the upper part of upper molding form 43 through piston rod 66. This pressure can be on the order of 400 tons and produces a stronger and superior textured block. This high pressure, which opposes the pressure of the heated concrete slurry, forces any excess material and water from the molding cavity returning via conduit 47 to the operation. The molding cavity is maintained for a few moments and upper molding form 43, with its divider 48, is then raised to its retracted position in which its bottom extreme is at a height greater than the height of the block being produced. Simultaneously lower molding form 44 drops, leaving reinforcement members 57 entrapped in the paired concrete block. The paired block is now in stable condition and has a temperature of approximately 190° F. but in contrast to prior art blocks, contains a large amount of moisture which must be removed. At this stage, all obstruction to the pallet in the molding area have been removed and the pallet is thus advanced from the molding station to the curing area for the removal of this excess moisture. As the block and the pallet leave the molding station, a new pallet moves into position and new reinforcement members are advanced, repeating the cycle described above. The formed blocks thus proceed through the curing area 12 including heater 13 and cooling area 14 and move onto ejection station 15.

The individual stations, areas and components of the machine are appropriately timed and sequenced to provide for continuous operation. Thus the molding operation is capable of producing a group of blocks every 6 seconds. If five blocks are prepared in each molding operation, this corresponds to a production rate of 50 blocks per minute or twenty-four thousand blocks in an 8 hour shift. Since the initial application of heat in the curing step is generally conducted for about 5 minutes, the molding operation is reduced in rate rather than attempting to cure 50 pallet sat one time, which would require an exceptionally large drying or heating area.

As indicated, the configuration of the molding cavity can be varied widely, not only in terms of the number of blocks being simultaneously produced but also as to the surface conformation. Generally the only limitation is that the molding cavity should be oriented so that any rib such as 49 or 50 on the molding form (which is required to produce a complementing channel in the block) is oriented perpendicular to both the line along which the upper and lower molding forms move (in order to permit such motion) and to a tangent of the conveyor means (in order to permit eventual ejection). For example, channels in the blocks (for example to permit tongue-and-groove joining) can be produced by simply positioning ribs 50 on a pallet 17, which ribs transverse to the direction the pallet moves, and by rib 49 on divider 48, again transverse to the direction the pallet moves.

The machine of the present invention thus provide for exceptionally high production rates of reinforced concrete blocks having exceptionally high uniformity of dimensions, exceptional strength and improved surface appearance.

I claim:

1. An apparatus for the continuous production of reinforced concrete blocks comprising (1) a plurality of like pallets, each having a substantially planar upper surface with at least one opening defined therein;

(2) a molding station, said station including (a) block molding means comprising upper and lower molding forms, said forms being separated moveable along a common vertical axis from a first molding position in which said lower molding form is indexed through the opening of one of said pallets at said molding station and together with said upper molding form and said pallet defines a block forming cavity, to a second, retracted position in which said lower molding form is at a position below said pallet and said upper molding form is at a position above said pallet at a height greater than the maximum height of the block being produced, (b) means operable to reciprocally move said upper molding form between said first and second position, (c) means operable to reciprocally move said lower molding form between said first and second position, (d) means operable to insert, when said upper molding form is in said second, retracted position, a reinforcement member into the area corresponding to said block forming cavity, (e) means operable to introduce under pressure a heated slurry of concrete fluid into said block forming cavity when both said upper and lower molding forms are in their first positions, and (f) means operable for applying pressure to said slurry in said cavity;

(3) a curing area disposed downstream from said molding station, said curing area including means operable to remove excess moisture from said blocks;

(4) an ejector station disposed downstream from said curing area and having means operable to remove a cured block from said pallet; and (5) circular conveyor means operable to carry said pallets through said molding station, said curing area and said ejector station, said circular conveyor means providing intermittent motion for said pallets at least through said molding station.

2. Apparatus according to claim 1 wherein said lower molding form is adapted to cooperate with said reinforcement member inserting means and to receive said reinforcement member when said lower form is in its first position and said upper form is in its second position.

3. Apparatus according to claim 2 wherein said reinforcement member inserting means introduce reinforcement members at right angles both to the axis along which said upper and lower molding forms move and to a tangent to said circular conveyor means at said molding station.

4. Apparatus according to claim 3 including means adjacent said molding stations and operable to cut and form said reinforcement members from continuous stock advancing along a line parallel to a tangent to said circular conveyor means at said molding station.

5. Apparatus according to claim 2 wherein said upper molding form includes an inner mold divider, said divider complementing said lower molding form when carrying said reinforcement member so as to define paired block forming cavities with portions of said reinforcement member extending into the base of said cavities.

6. Apparatus according to claim 5 wherein said upper and lower molding forms define a plurality of paired block forming cavities.

7. Apparatus according to claim 6 including means adjacent said molding station and operable to cut and form said reinforcement members in a whole number multiple of said plurality of paired cavities from continuous stock advancing along a line parallel to a tangent to said circular conveyor means at said molding station and said reinforcement member inserting means are operable to simultaneously introduce to the areas between said cavity pairs a quantity of said reinforcement members corresponding to said whole number.

8. Apparatus according to claim 1 wherein said curing area provides a source of high frequency radiation.

* * * * *